US010143308B2

(12) United States Patent
Walker et al.

(10) Patent No.: US 10,143,308 B2
(45) Date of Patent: Dec. 4, 2018

(54) SEATING DEVICE

(71) Applicant: Herman Miller, Inc., Zeeland, MI (US)

(72) Inventors: Brock Walker, Okemos, MI (US); Mark Goetz, Brooklyn, NY (US)

(73) Assignee: Herman Miller, Inc., Zeeland, MI (US)

( * ) Notice: Subject to any disclaimer, the term of this patent is extended or adjusted under 35 U.S.C. 154(b) by 182 days.

(21) Appl. No.: 15/218,958

(22) Filed: Jul. 25, 2016

(65) Prior Publication Data

US 2017/0020292 A1 Jan. 26, 2017

Related U.S. Application Data

(60) Provisional application No. 62/196,200, filed on Jul. 23, 2015.

(51) Int. Cl.

| | |
|---|---|
| ***A47C 3/027*** | (2006.01) |
| ***A47C 3/025*** | (2006.01) |
| ***A47C 3/026*** | (2006.01) |
| ***A47C 3/18*** | (2006.01) |
| ***A47C 3/30*** | (2006.01) |

(Continued)

(52) U.S. Cl.

CPC ..... *A47C 3/027* (2013.01); *A47C 1/032* (2013.01); *A47C 3/026* (2013.01); *A47C 3/0252* (2013.01); *A47C 3/0255* (2013.01); *A47C 3/18* (2013.01); *A47C 3/30* (2013.01); *A47C 7/006* (2013.01);

(Continued)

(58) Field of Classification Search

CPC ..... A47C 1/032; A47C 9/025; A47C 3/0252; A47C 7/50; A47C 7/44; A47C 7/006; A47C 3/027; A47C 3/026; A47C 3/0255; A47C 1/03233; A47C 1/03261; A47C 1/03255

USPC ..... 297/261.4, 262.1, 258.1, 300.2, 259.1, 297/259.3, 271.2, 261.2

See application file for complete search history.

(56) References Cited

U.S. PATENT DOCUMENTS

| | | | |
|---|---|---|---|
| 282,371 | A | 7/1883 | Rintelman |
| 476,805 | A | 6/1892 | Mason |

(Continued)

FOREIGN PATENT DOCUMENTS

| | | |
|---|---|---|
| CA | 1039638 | 10/1978 |
| GB | 2167947 | 6/1988 |

(Continued)

OTHER PUBLICATIONS

Office Chair Mechanisms—Swivel, Tilt, Manual, Gas dated Aug. 17, 2015 (3 pages).

(Continued)

*Primary Examiner* — Chi Q Nguyen

(74) *Attorney, Agent, or Firm* — Michael Best & Friedrich LLP

(57) ABSTRACT

A seating device includes a base and a seat post extending from the base. The seat post has a first end adjacent the base, a second end opposite the first end, and a longitudinal axis extending between the first end and the second end. The seating device further includes a seat supported by the seat post above the base and a first rocking assembly coupled to the base and the first end of the seat post. The first rocking assembly is operable to angularly displace the seat post relative to the base. The seating device further includes a second rocking assembly coupled to the seat and the second end of the seat post. The second rocking assembly is operable to angularly displace the seat relative to the seat post.

19 Claims, 9 Drawing Sheets

(51) Int. Cl.

| | |
|---|---|
| ***A47C 7/00*** | (2006.01) |
| ***A47C 7/40*** | (2006.01) |
| ***A47C 7/50*** | (2006.01) |
| ***A47C 7/54*** | (2006.01) |
| ***A47C 1/032*** | (2006.01) |
| ***A47C 9/02*** | (2006.01) |

(52) U.S. Cl.
CPC ..... *A47C 7/40* (2013.01); *A47C 7/50* (2013.01); *A47C 7/54* (2013.01); *A47C 9/025* (2013.01)

(56) References Cited

U.S. PATENT DOCUMENTS

| | | | | |
|---|---|---|---|---|
| 517,929 | A | 4/1894 | March | |
| 1,555,689 | A * | 9/1925 | Miller | A47C 3/027 297/262.1 |
| 3,434,755 | A * | 3/1969 | Caldemeyer | A47C 3/027 297/269.1 |
| 3,464,736 | A * | 9/1969 | Mizelle | A47C 1/0345 297/259.2 |
| 3,480,249 | A | 11/1969 | Lie | |
| 4,099,697 | A | 7/1978 | Von Schuckmann | |
| 4,131,260 | A | 12/1978 | Ambasz | |
| 4,183,579 | A | 1/1980 | Gonzalez y. Rojas | |
| 4,575,151 | A | 3/1986 | Edstrom | |
| 4,641,885 | A * | 2/1987 | Brauning | A47C 1/03277 297/303.1 |
| 4,718,726 | A | 1/1988 | Estkowski et al. | |
| 4,765,684 | A | 8/1988 | Kvalheim et al. | |
| 4,872,727 | A | 10/1989 | Rye | |
| 4,932,719 | A | 6/1990 | Gonzalez y. Rojas | |
| 5,590,930 | A | 1/1997 | Glockl | |
| 6,120,094 | A * | 9/2000 | Parent | A47C 3/0255 297/270.1 |
| 6,206,335 | B1 | 3/2001 | Huber et al. | |
| 6,601,818 | B1 * | 8/2003 | Larsen | A47C 3/0255 248/158 |
| 6,945,602 | B2 | 9/2005 | Fookes et al. | |
| 7,081,075 | B2 * | 7/2006 | Sachs | A63B 26/003 482/146 |
| 7,134,720 | B2 * | 11/2006 | Viger | A47C 1/032 297/270.1 |
| 7,207,629 | B2 | 4/2007 | Goetz et al. | |
| 7,478,878 | B2 | 1/2009 | Oettinger | |
| 7,500,718 | B2 | 3/2009 | Fookes | |
| 7,547,067 | B2 | 6/2009 | Keilhauer et al. | |
| 7,841,666 | B2 | 11/2010 | Schmitz et al. | |
| 7,878,591 | B2 | 2/2011 | Walker et al. | |
| 8,066,624 | B1 | 11/2011 | Stroup | |
| 8,540,314 | B2 | 9/2013 | Fernandez | |
| 8,888,181 | B2 | 11/2014 | Perraut et al. | |
| 8,944,507 | B2 | 2/2015 | Goetz | |
| 2003/0071502 | A1 * | 4/2003 | Marshall | A47C 1/03255 297/302.1 |
| 2004/0195881 | A1 | 10/2004 | Wells | |
| 2006/0175884 | A1 | 8/2006 | Jenkins | |
| 2009/0140567 | A1 | 6/2009 | Weiss | |
| 2011/0175414 | A1 | 7/2011 | Asbjornsen | |
| 2012/0216347 | A1 * | 8/2012 | Tundo | A47C 3/02 5/109 |
| 2012/0304370 | A1 | 12/2012 | Gianfagna et al. | |
| 2013/0306831 | A1 | 11/2013 | Keen et al. | |
| 2016/0073786 | A1 | 3/2016 | Walker et al. | |
| 2016/0157618 | A1 | 6/2016 | Arnett | |
| 2017/0007026 | A1 | 1/2017 | Avery | |

FOREIGN PATENT DOCUMENTS

| | | |
|---|---|---|
| JP | S6452536 | 2/1989 |
| JP | 2001506149 | 5/2001 |
| JP | 2014004324 | 10/2004 |
| JP | 2007268118 | 1/2014 |
| KR | 101333318 | 11/2013 |
| WO | 2014179815 | 11/2014 |

OTHER PUBLICATIONS

International Search Report of Application No. PCT/US2016/043905 dated Nov. 1, 2016 (3 pages).
Written Opinion of the International Searching Authority for Application No. PCT/US2016/043905 dated Nov. 1, 2016 (11 pages).

* cited by examiner

SEATING DEVICE

CROSS-REFERENCE TO RELATED APPLICATIONS

This application claims priority to U.S. Provisional Patent Application No. 62/196,200, filed Jul. 23, 2015, the entire contents of which are hereby incorporated by reference.

BACKGROUND

This invention relates to the field of seating devices, and more particularly to sit-stand seats or stools that can tilt forward to provide balanced support for seated to near-standing postures.

SUMMARY

In one embodiment, the invention provides a seating device including a base and a seat post extending from the base. The seat post has a first end adjacent the base, a second end opposite the first end, and a longitudinal axis extending between the first end and the second end. The seating device further includes a seat supported by the seat post above the base and a first rocking assembly coupled to the base and the first end of the seat post. The first rocking assembly is operable to angularly displace the seat post relative to the base. The seating device further includes a second rocking assembly coupled to the seat and the second end of the seat post. The second rocking assembly is operable to angularly displace the seat relative to the seat post.

In another embodiment, the invention provides a rocking assembly for a seating device. The seating device includes a base, a seat post extending from the base and having a first end adjacent the base and a second end opposite the first end, and a seat supported by the seat post above the base. The rocking assembly includes a cam configured to be coupled to the first end of the seat post. The cam has a cam surface with a first series of engagement elements formed on the cam surface. The seating device further includes a cam follower configured to be coupled to the base. The cam follower has a second series of engagement elements intermeshed with the first series of engagement elements of the cam surface. The seating device further includes an energy storage member coupled to the cam and the cam follower to urge the cam follower into engagement with the cam. The cam is movable relative to the cam follower to change an orientation of the seat post relative to the base.

In another embodiment, the invention provides a seating device including a base, a plurality of wheels coupled to the base for supporting the base on a support surface, and a seat post extending from the base. The seat post has a first end adjacent the base, a second end opposite the first end, and a longitudinal axis extending between the first end and the second end. The seating device further includes a seat supported by the seat post above the base and a first rocking assembly operable to angularly displace the seat post relative to the base. The first rocking assembly includes a first cam coupled to the first end of the seat post, a first cam follower coupled to the base and engaging the first cam, and a first energy storage member coupled to the first cam and the first cam follower to maintain contact between the first cam and the first cam follower. The seating device further includes a second rocking assembly operable to angularly displace the seat relative to the seat post. The second rocking assembly includes a second cam coupled to the seat, a second cam follower coupled to the second end of the seat post and engaging the second cam, and a second energy storage member coupled to the second cam and the second cam follower to maintain contact between the second cam and the second cam follower.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
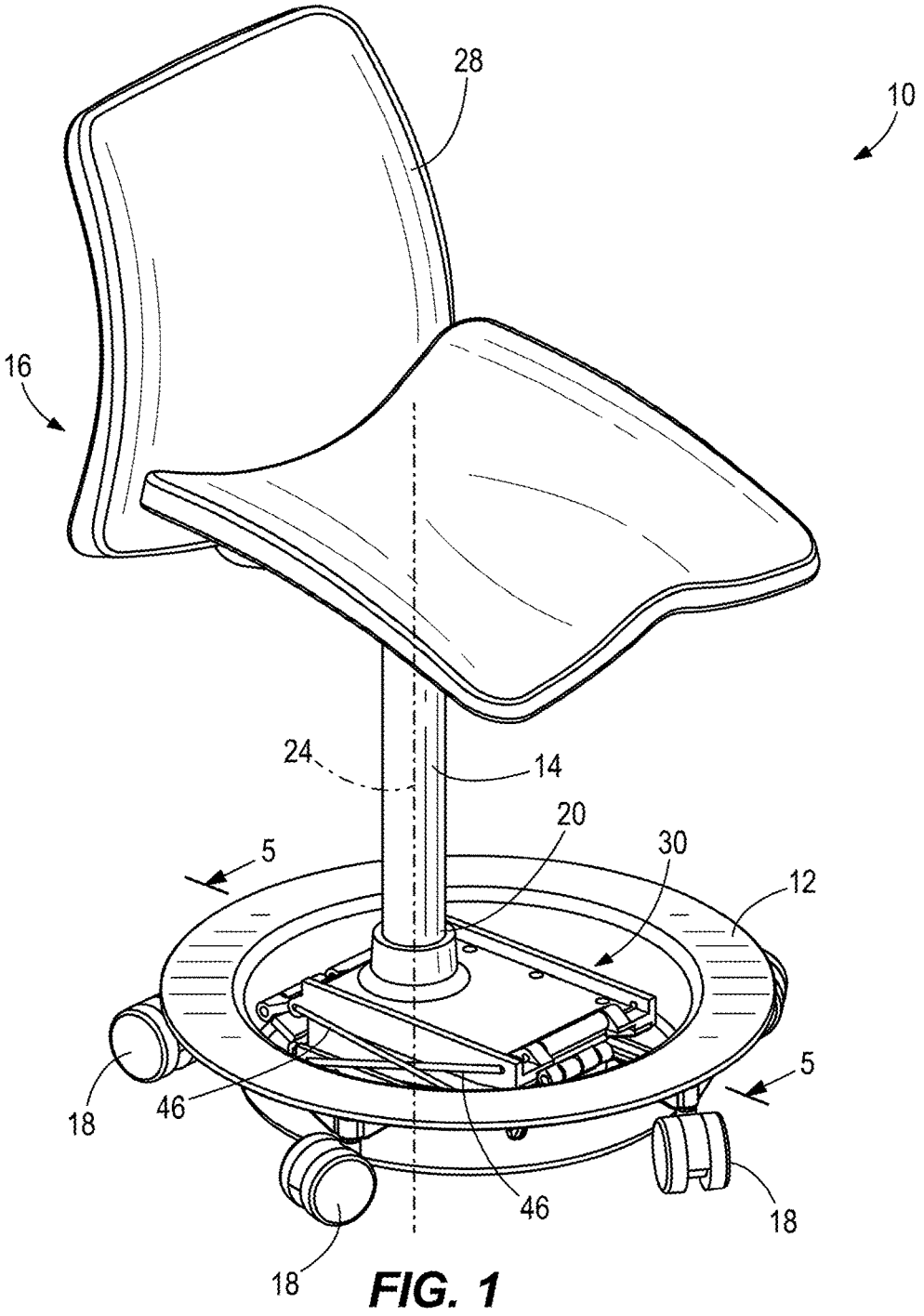
FIG. 1 is a top perspective view of a chair according to an embodiment of the invention.
Figure 2:
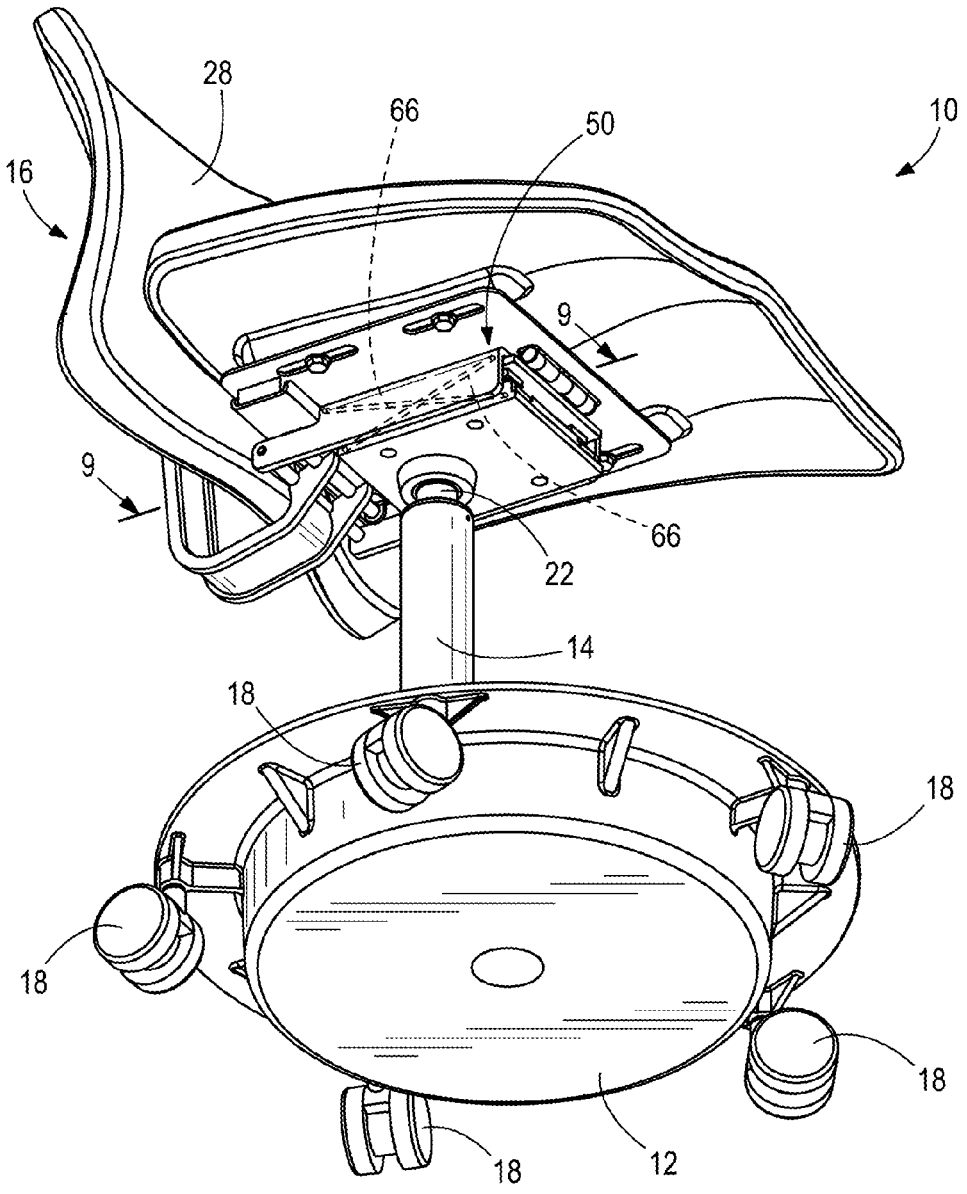
FIG. 2 is a bottom perspective view of the chair of FIG. 1.

FIGS. 1 and 2 illustrate a chair 10, which is particularly suited for long vertical height adjustment. For example, the chair 10 is adjustable between a first, relatively low height (e.g., a desk chair height) and a second, relatively high height (e.g., a stool or perch height). The chair 10 includes a base 12, a seat post 14 extending from the base 12, and a seat 16 supported by the seat post 14 above the base 12. The base 12 includes a plurality of wheels 18 to the support the chair 10 on a ground surface. In the illustrated embodiment, the wheels 18 are swivel-type caster wheels. The seat post 14 has a first end 20 (FIG. 1) adjacent the base 12, a second end 22 (FIG. 2) opposite the first end 20 that is adjacent the seat 16, and a longitudinal axis 24 that extends from the first end 20 to the second end 22. The seat post 14 is vertically adjustable in a direction parallel to the longitudinal axis 24 either manually or automatically, preferably pneumatically via a gas spring or other type of actuators. Generally, the seat 16 defines a plane 26 (FIGS. 6 and 7) adjacent the underside of the seat 16 and further includes a back support 28. The seat 16 is capable of rotating about the longitudinal axis 24. In some embodiments, the seat 16 may also include arm rests.

Figure 3:
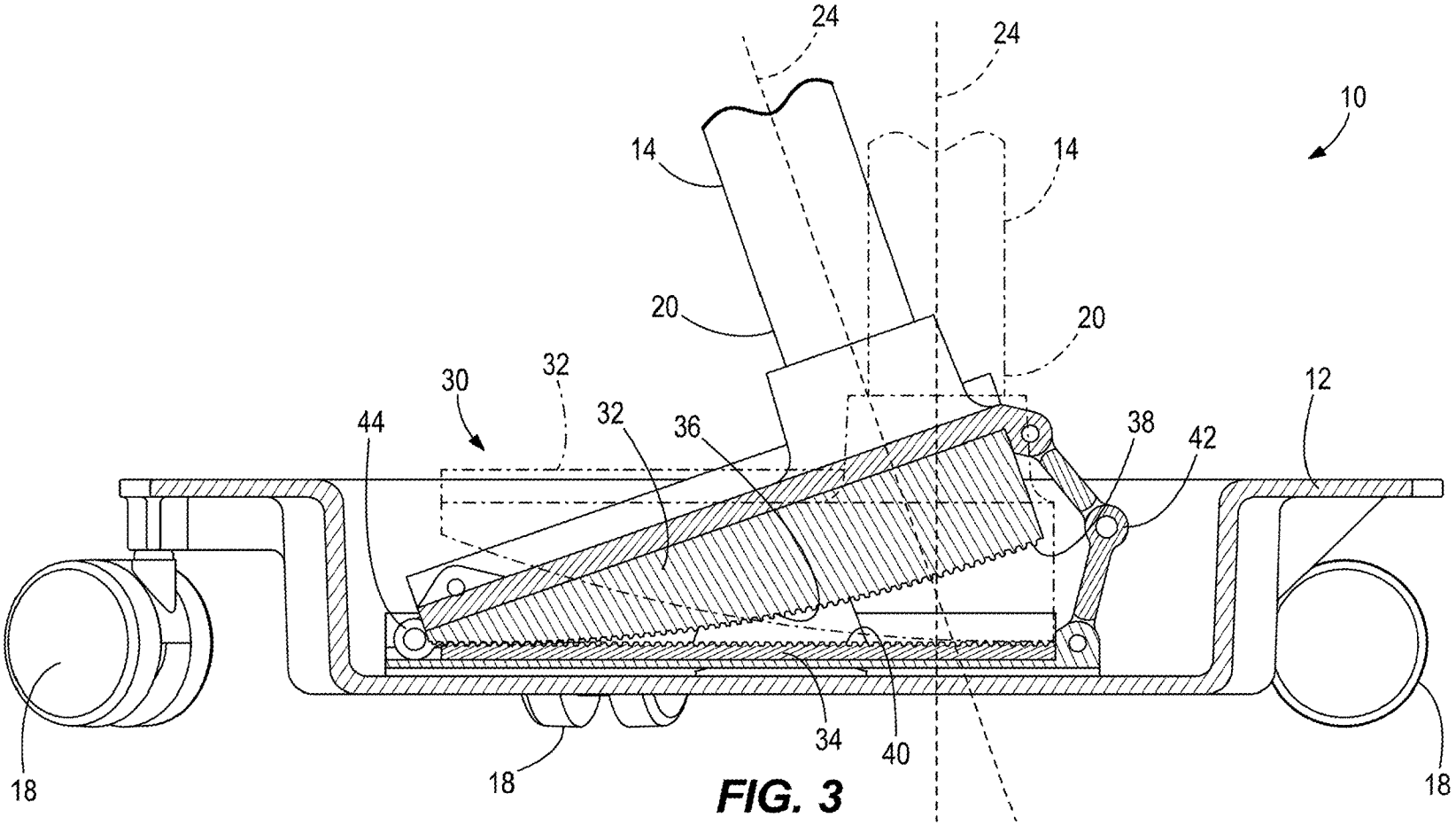
FIG. 3 is a side view of the chair, illustrating a first rocking assembly in a first position and a second position.

With reference to FIGS. 1 and 3, the chair 10 further includes a first rocking assembly 30. The first rocking assembly 30 is coupled to the base 12 and the first end 20 of the seat post 14. Specifically, the first rocking assembly 30 is interposed between the base 12 and the seat post 14 such that the first rocking assembly 30 is operable to angularly displace the seat post 14 relative to the base 12. In other words, the first rocking assembly 30 is capable of pivoting the seat post 14 between a first position (shown in broken lines in FIG. 3), in which the longitudinal axis 24 is substantially perpendicular to the ground surface, and a second position, in which the longitudinal axis 24 is obliquely angled relative to the ground surface (shown in solid lines in FIG. 3).

Figure 4:
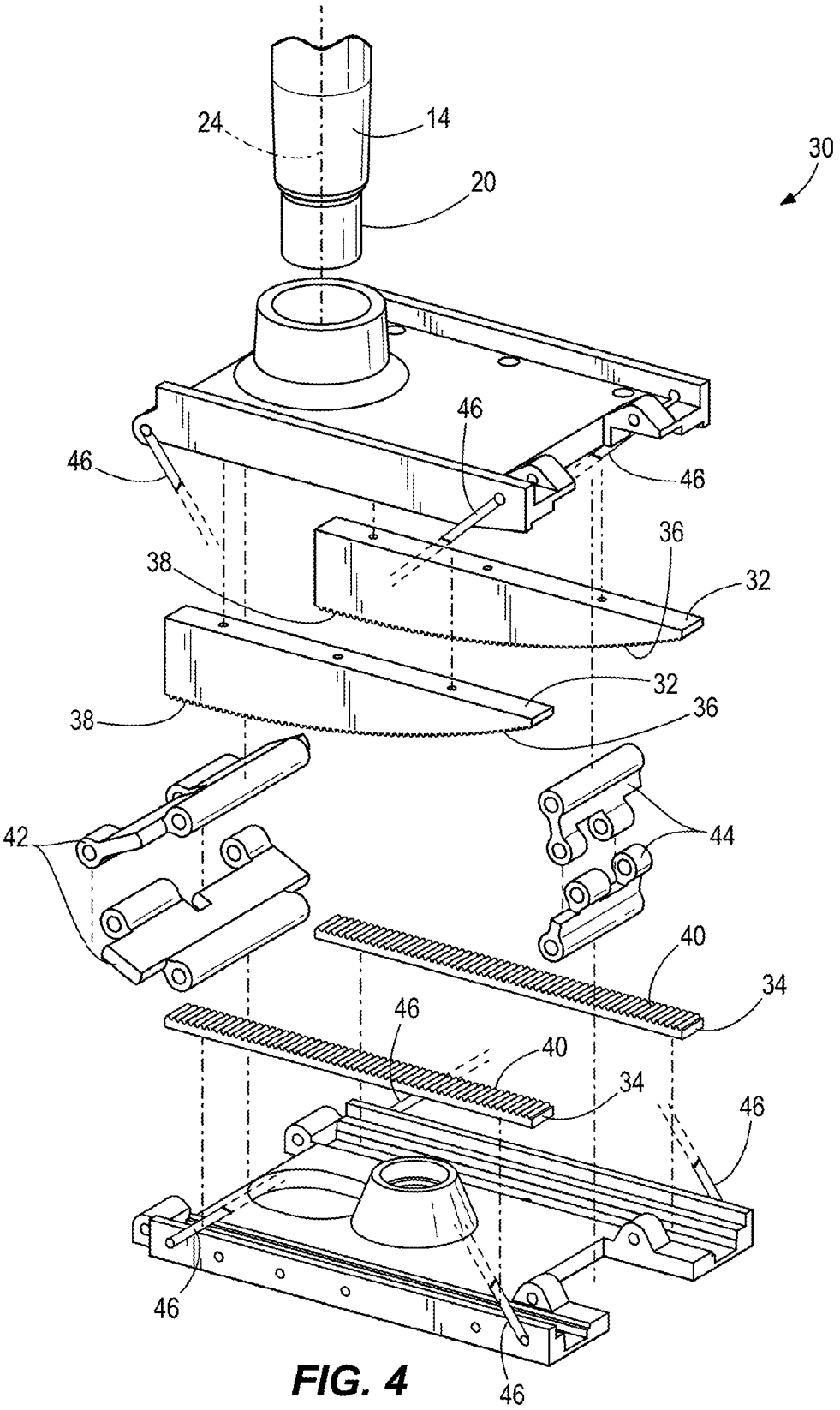
FIG. 4 is an exploded perspective view of the first rocking assembly.
Figure 5:
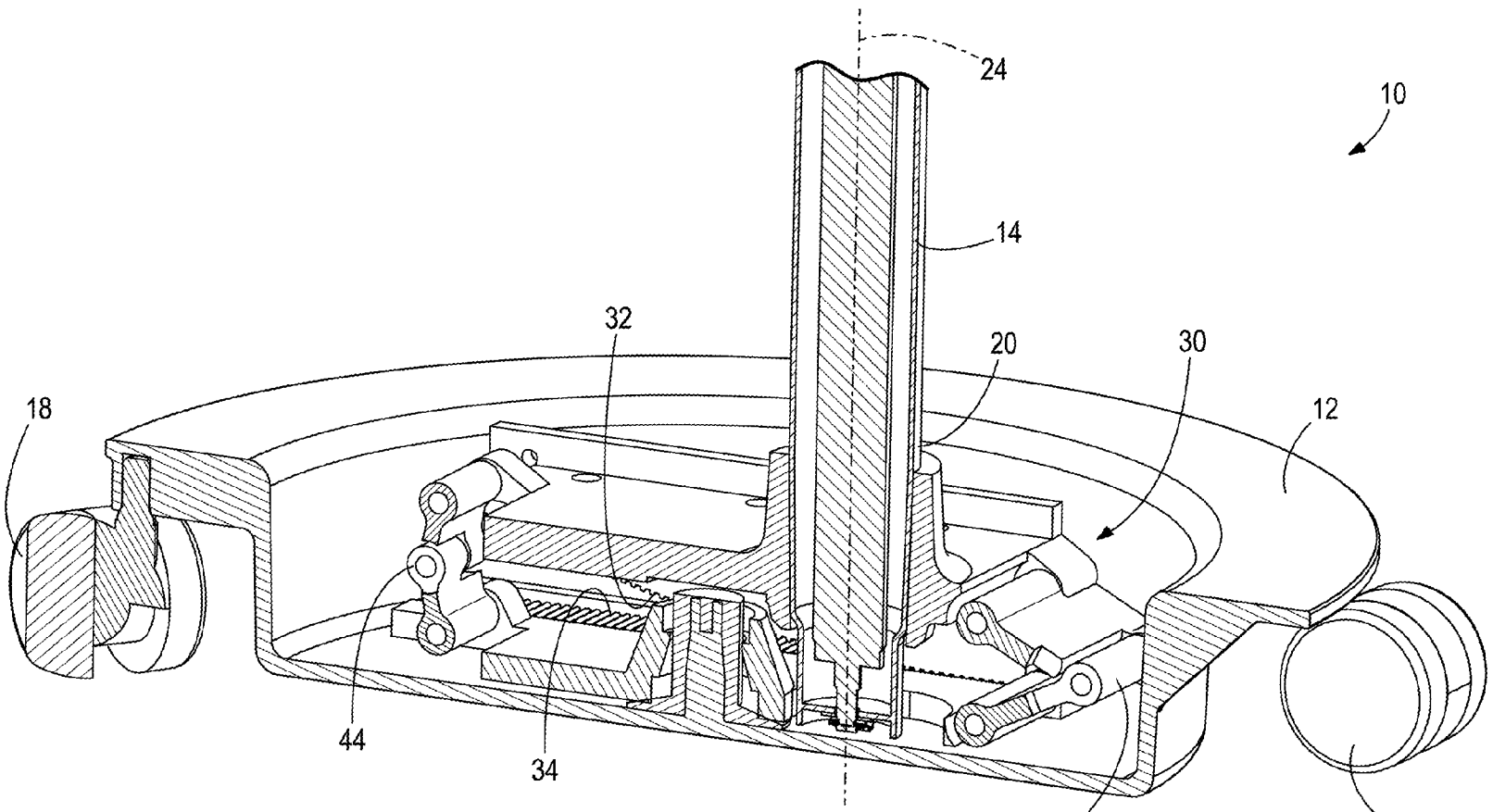
FIG. 5 is a cross-sectional view of the first rocking assembly taken along line 5-5 of FIG. 1.

With reference to FIGS. 4 and 5, the first rocking assembly 30 includes a first cam 32 coupled to the first end 20 of the seat post 14. The first rocking assembly 30 also includes a first cam follower 34 that is engaged with the first cam 32 and that is coupled to the base 12. The first cam 32 has a cam surface 36 defining an arcuate profile that comes in contact with a substantially planar profile of the first cam follower 34. As such, the cam surface 36 is tangentially engaged with the first cam follower 34 as the seat post 14 moves between the first and second positions. As illustrated, the cam surface 36 of the first cam 32 includes a series of first engagement elements 38 that intermesh with a corresponding series of second engagement elements 40 of the first cam follower 34. The series of first and second engagement elements 38, 40 are meshed together to inhibit slipping of the first cam 32 relative to the first cam follower 34. As illustrated, the engagement elements 38, 40 are teeth. In other embodiments, the cam surface 36 and the first cam follower 34 may alternatively have respective smooth surfaces with a high coefficient of friction (e.g., rubber, synthetic rubbers, etc.) to inhibit slipping therebetween. Still, in other embodiments, the cam surface 36 and the first cam follower 34 may be compatibly geared, notched, or sprocketed to facilitate contact and reduce slippage.

With continued reference to FIGS. 4 and 5, the first rocking assembly 30 further includes a first two-bar linkage 42 and a second two-bar linkage 44, each of which are coupled between the first cam 32 and the first cam follower 34. The first and second two-bar linkages 42, 44 are oppositely disposed on the first rocking assembly 30 and each move between a retracted position and an extended position. For example, when the seat post 14 is in the first position (FIG. 5), the first two-bar linkage 42 is in the retracted position while the second two-bar linkage 44 is in the extended position, and vise versa when the seat post 14 is in the second position. When one of the two-bar linkages 42, 44 is in the extended position, the seat post 14 is inhibited from angularly displacing beyond the respective position. Therefore, the first and second two-bar linkages 42, 44 limit displacement of the first cam 32 relative to the first cam follower 34, thereby limiting the range of angular displacement between the base 12 and the seat post 14. Although the linkages 42, 44 are illustrated as two-bar linkages, in other embodiments, the linkages 42, 44 may alternatively be a single monolithic link having a guide and a pin received within the guide to limit angular displacement of the seat post 14 relative to the base 12. Still, in other embodiments, the linkages 42, 44 may have more than two linkages (e.g., three linkages, four linkages, etc.).

The first rocking assembly 30 further includes energy storage members 46 coupled to the first cam 32 and the first cam follower 34, as shown in FIG. 4. The energy storage members 46 of the first rocking assembly 30 exert a force to urge the first cam 32 toward the first cam follower 34 to ensure contact is maintained therebetween. Also, the forces exerted by the energy storage members 46 bias the seat post 14 toward the first position. As illustrated, the energy storage members 46 are elastic bands that are composed of an elastomeric material. In other embodiments, the energy storage members 46 may alternatively be springs or other types of biasing members. In some embodiments, the first rocking assembly 30 may include only one energy storage member 46.

Figure 6:
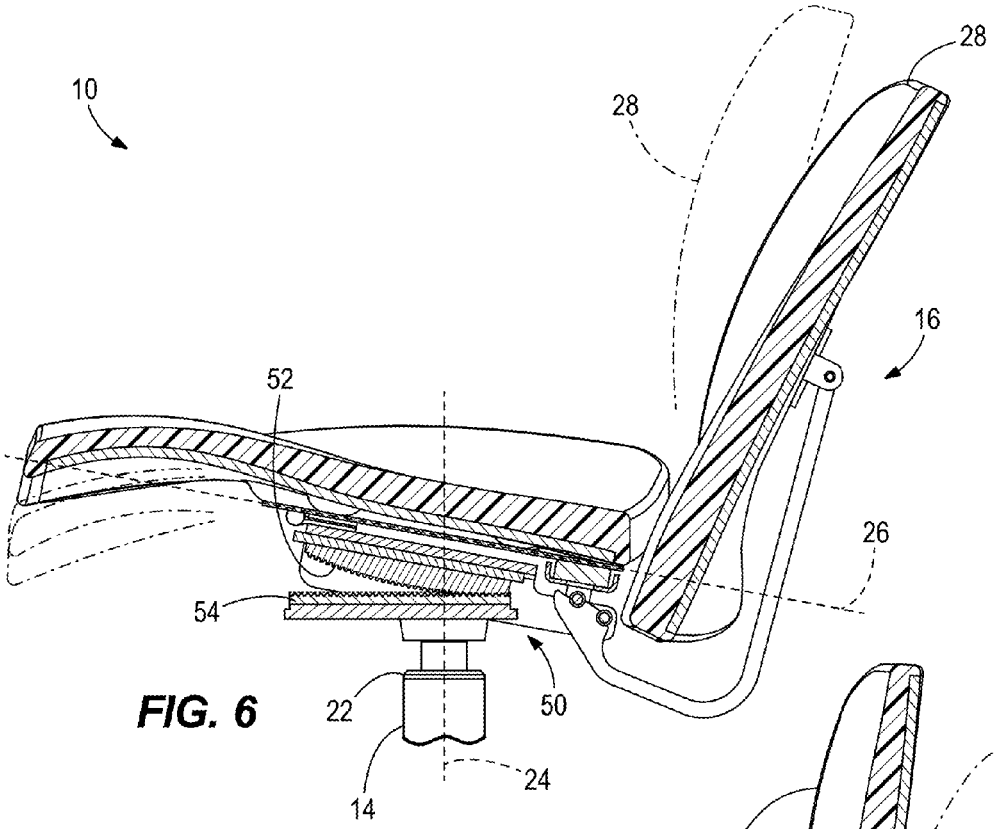
FIG. 6 is a side view of the chair, illustrating a second rocking assembly in a neutral position and a second position.
Figure 7:
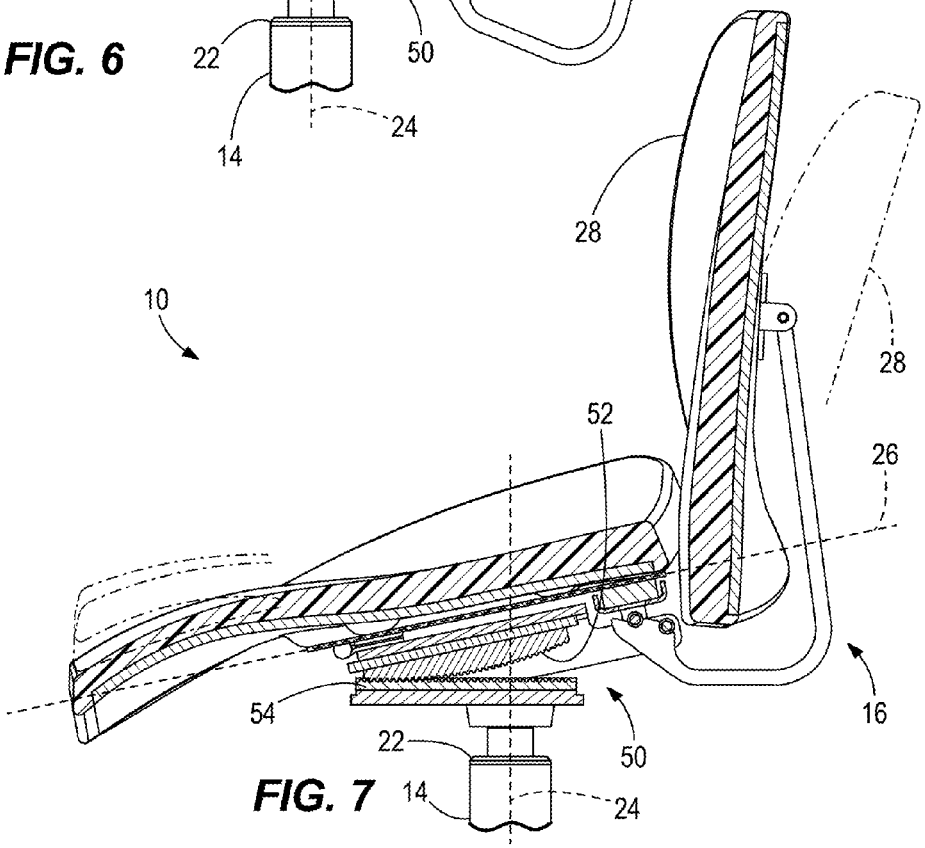
FIG. 7 is a side view of the sit-stand chair, illustrating a second rocking assembly in the neutral position and a first position.

With reference to FIGS. 6 and 7, the chair 10 further includes a second rocking assembly 50. The second rocking assembly 50 is coupled to the seat 16 and the second end 22 of the seat post 14. Specifically, the second rocking assembly 50 is interposed between the seat 16 and the seat post 14 such that the second rocking assembly 50 is operable to angularly displace the seat 16 relative to the seat post 14. In other words, the second rocking assembly 50 is capable of pivoting the seat 16 between a first or "tilted-forward position" (shown in solid lines in FIG. 7), in which the plane 26 is tilted forward and obliquely angled relative to the longitudinal axis 24, and a second or "tilted-rearward position" (shown in solid lines in FIG. 6), in which the plane 26 is tilted rearward and obliquely angled relative to the longitudinal axis 24 (shown in broken lines in FIG. 6). The seat post 14 is also capable of a neutral position (shown in broken lines in FIGS. 6 and 7), in which the plane 26 of the seat 16 is substantially perpendicular to the longitudinal axis 24.

Figure 8:
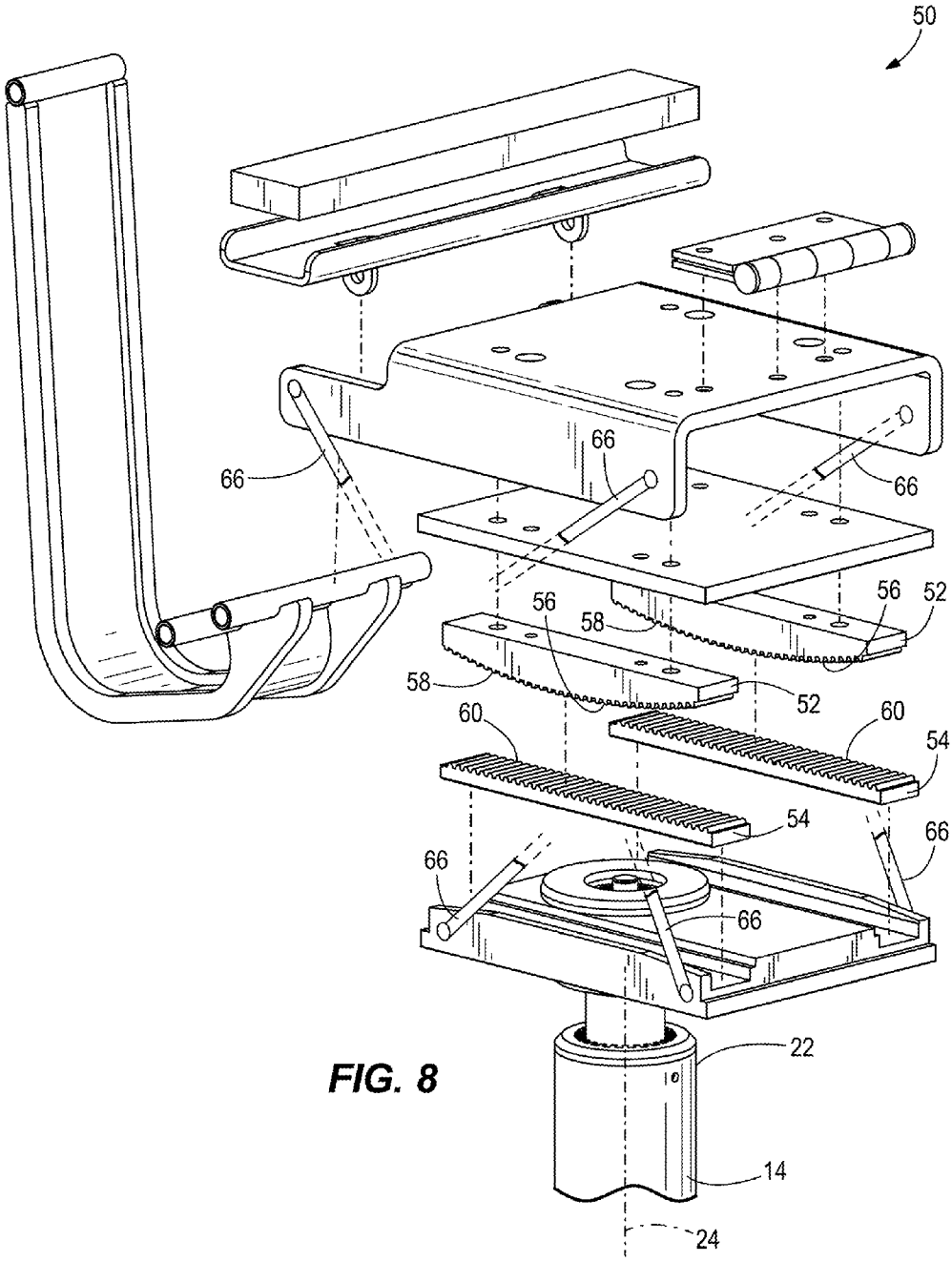
FIG. 8 is an exploded perspective view of the second rocking assembly.
Figure 9:
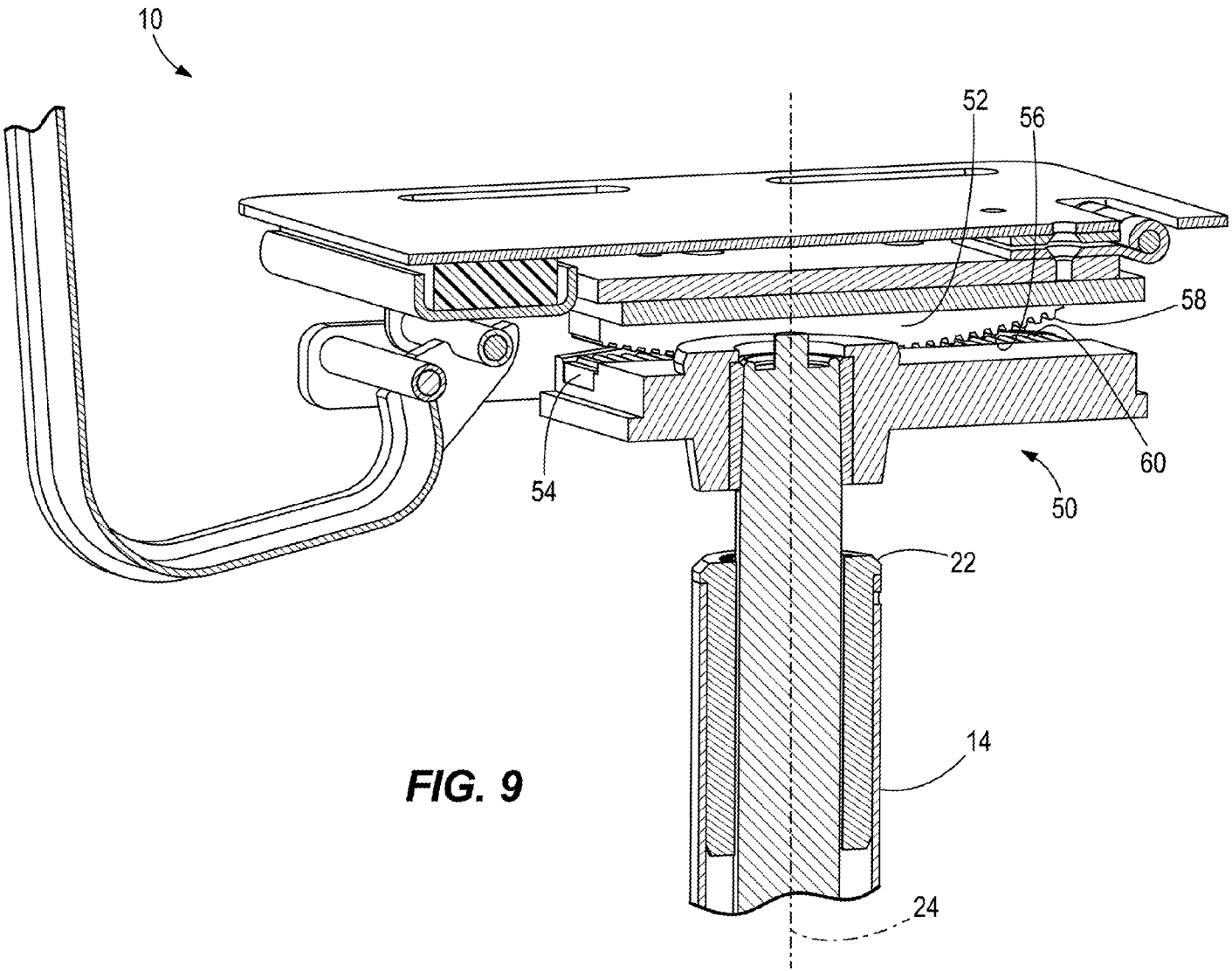
FIG. 9 is a cross-sectional view of the second rocking assembly taken along line 9-9 of FIG. 2.

With reference to FIGS. 8 and 9, the second rocking assembly 50 includes a second cam 52 coupled to the seat 16. The second rocking assembly 50 also includes a second cam follower 54 that is engaged with the second cam 52 and that is coupled to the second end 22 of the seat post 14. The second cam 50 has a cam surface 56 defining an arcuate profile that comes in contact with a substantially planar profile of the second cam follower 54. As such, the cam surface 56 is tangentially engaged with the second cam follower 54 when the seat 16 moves between the neutral, first, and second positions. As illustrated, the cam surface 56 of the second cam 52 includes a series of third engagement elements 58 that intermesh with a corresponding series of fourth engagement elements 60 of the second cam follower 54. The series of third and fourth engagement elements 58, 60 are meshed together to inhibit slipping of the second cam 52 relative to the second cam follower 54. As illustrated, the engagement elements 58, 60 are teeth. In other embodiments, the cam surface 56 and the cam follower 54 may alternatively have respective surfaces with a high coefficient of friction (e.g., rubber, synthetic rubbers, etc.) to inhibit slipping therebetween. Still, in other embodiments, the cam surface 56 and the second cam follower 54 may be compatibly geared, notched, or sprocketed to facilitate contact and reduce slippage.

Although not shown, the second rocking assembly 50 can further include a pair of two-bar linkages similar to the two-bar linkages 42, 44 of the first rocking assembly 30. As such, the range of angular displacement between the seat 16 and the seat post 14 can be limited via the two-bar linkages of the second rocking assembly 50.

The second rocking assembly 50 further includes energy storage members 66 coupled to the second cam 52 and the second cam follower 54, as shown in FIG. 8. The energy storage members 66 of the second rocking assembly 50 exert a force to urge the second cam 52 toward the second cam follower 54 to ensure contact is maintained therebetween. Also, the forces exerted by the energy storage members 66 bias the seat 16 toward the neutral position. As illustrated, the energy storage members 66 are elastic bands that are composed of an elastomeric material. In other embodiments, the energy storage members 66 may alternatively be springs or other types of biasing members. In some embodiments, the second rocking assembly 50 may include only one energy storage member 66.

In operation, a user may optionally sit in the chair 10 such that the user's weight is supported by the chair 10 or leaned against the chair 10 such that a portion of the user's weight is supported by the chair 10. By adjusting the user's center of gravity (COG) relative to the chair 10, the user moves the seat post 14 between the first and second positions (FIG. 3), and moves the seat 16 between the neutral, first, and second positions (FIGS. 6 and 7). For example, when the user's COG is substantially above the seat post 14, the seat post 14 is in the first position. In contrast, when the user's COG is forward of the seat post 14, the seat post 14 is in the second position. Also, the first rocking assembly 30 and the second rocking assembly 50 move independently of each other. As a result, the seat 16 is capable of being in one of the neutral, first, and second positions when the seat post 14 is in the first position or the second position.

In some embodiments, the second rocking assembly 50 may be omitted such that the chair 10 only includes the first rocking assembly 30 at the base 12 to angularly displace the seat 16.

Figure 10:
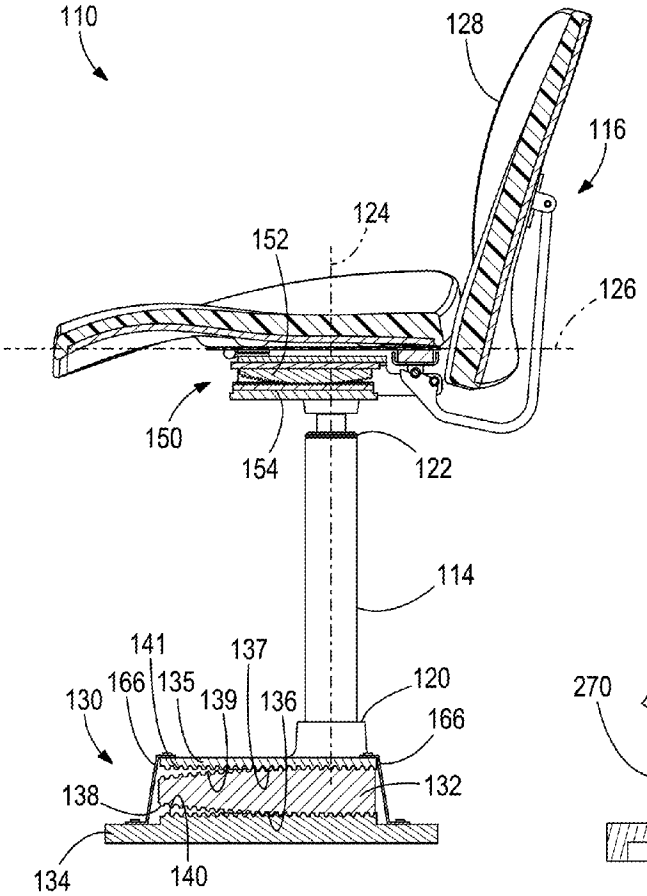
FIG. 10 is a side view of a chair according to another embodiment of the invention.

FIG. 10 illustrates a chair 110 in accordance with another embodiment of the invention. The chair 110 includes a first rocking assembly 130, but is otherwise similar to the chair 110 described above with reference to FIGS. 1-9, with like components being shown with like reference numerals plus 100. Only differences between the chairs 10, 110 are described below.

The illustrated chair 110 includes a seat post 114, a chair 116 supported by the seat post 114, a first rocking assembly 130, and a second rocking assembly 150. As shown, the first rocking assembly 130 includes a first cam 132, a first cam follower 134, a second cam follower 135, and a plurality of energy storage members 166 coupled between the first cam follower 134 and the second cam follower 135. The first cam 132 includes a first cam surface 136 having a series of engagement elements 138 that intermesh with a corresponding series of engagement elements 140 of the first cam follower 134. Further, the first cam 132 includes a second cam surface 137 that is spaced apart and oppositely disposed from the first cam surface 136. The second cam surface 137 has a series of engagement elements 139 that intermesh with a corresponding series of engagement elements 141 of the second cam follower 135. Although the first rocking assembly 130 of the illustrated embodiment is supported on the ground surface, the first rocking assembly 130 may alternatively be supported by a base, similar to the base 12 of the chair 10.

In operation, the first cam 132 and the second cam follower 135 move independently of each other while the first cam follower 134 remains stationary. By adjusting the user's center of gravity (COG) relative to the chair 110, the user moves the seat post 114 between the first and second positions, and moves the seat 116 between the neutral, first, and second positions.

Figure 11:
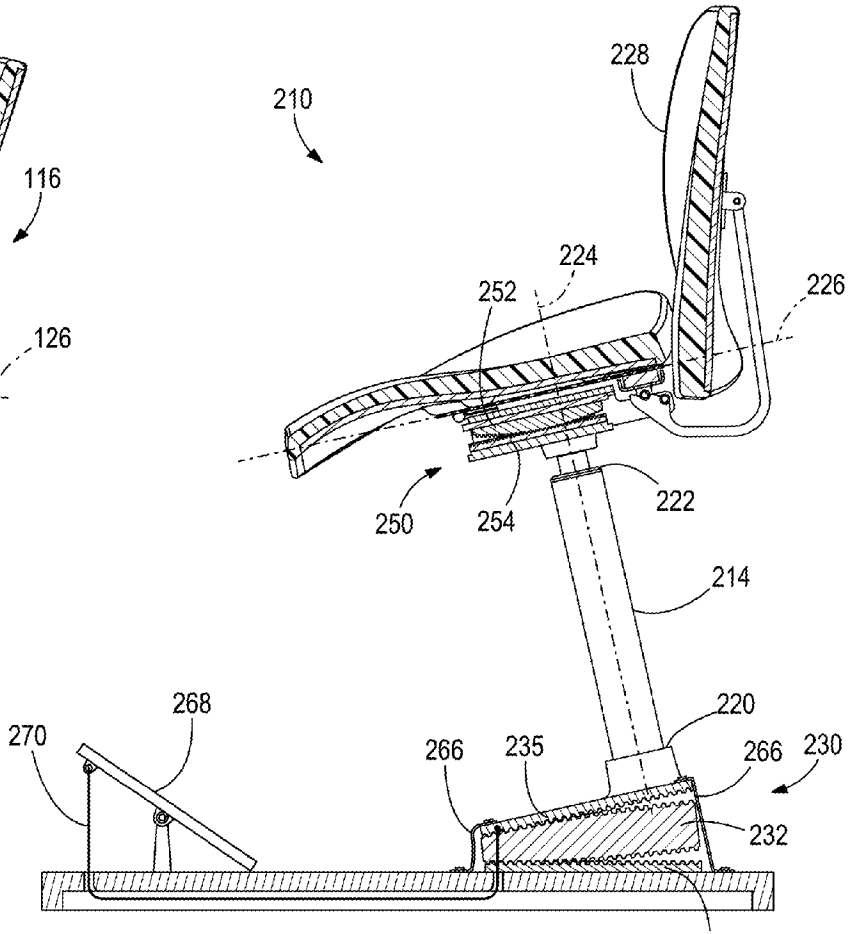
FIG. 11 is a side view of chair according to yet another embodiment of the invention.

FIG. 11 illustrates a chair 210 in accordance with another embodiment of the invention. The chair 210 includes a foot rest 268, but is otherwise similar to the chair 110 described above with reference to FIG. 10, with like component being shown with like reference numeral plus 100. Only differences between the chairs 110, 210 are described below.

The illustrated chair 210 includes a foot rest 268 extending from the first cam follower 134. The foot rest 268 is disposed forward of the chair 210 to allow a user's feet to be supported by the foot rest 268. The foot rest 268 is pivotally coupled to the first cam follower 134 such that the foot rest 268 rocks relative to the first cam follower 134. In the illustrated embodiment, the chair 210 further includes a tension member 270 (e.g., a cable, a cord, wire, etc.) coupled between the foot rest 268 and the second cam follower 235.

In operation, the user's feet controls (i.e., rocks or pivots) the foot rest 268 in order to correspondingly move the seat post 14 between the first and second positions. Specifically, as the foot rest 268 rocks in a clockwise direction, the tension member 270 urges the first cam 132 and the second cam follower 135 downward. As a result, the seat post 14 moves from the first position toward the second position. When the foot rest 268 is rocked in a counterclockwise direction, the energy storage members 246 bias the seat post 14 toward the first position.

Thus, the invention provides, among other things, a chair that is particularly suited for use as a relatively low desk chair and as a relatively high stool or perch. When the chair is provided with the first and second rocking assemblies as described herein, the chair provides improved posture support for a user throughout a wide range of forward and rearward sit-stand positions. The chair also offers the capability of tilting forward toward the work area while maintaining support for the lower back and/or sacral/pelvic region, ultimately reducing fatigue while improving seat stability, user range of motion, comfort, and overall task efficiency.

What is claimed is:

1. A seating device comprising:

a base;

a seat post extending from the base, the seat post having a first end adjacent the base, a second end opposite the first end, and a longitudinal axis extending between the first end and the second end;

a seat supported by the seat post above the base;

a first rocking assembly coupled to the base and the first end of the seat post, the first rocking assembly operable to angularly displace the seat post relative to the base; and a second rocking assembly coupled to the seat and the second end of the seat post, the second rocking assembly operable to angularly displace the seat relative to the seat post, wherein the first rocking assembly restricts the seat post to only move forwardly and rearwardly relative to the base with respect to a user seated in the seat.

2. The seating device of claim 1, wherein the base is configured to support the seating device on a support surface, wherein the first rocking assembly pivots the seat post between a first position, in which the longitudinal axis is substantially perpendicular to the support surface, and a second position, in which the longitudinal axis is obliquely angled relative to the support surface.

3. The seating device of claim 1, wherein a bottom of the seat defines a plane, wherein second rocking assembly pivots the seat between a first position, in which the longitudinal axis is substantially perpendicular to the plane, and a second position, in which the longitudinal axis is obliquely angled relative to the plane.

4. The seating device of claim 1, wherein the first rocking assembly and the second rocking assembly move independently of each other.

5. The seating device of claim 1, wherein the seat post is vertically adjustable in a direction parallel to the longitudinal axis.

6. The seating device of claim 1, wherein the seat includes a back support.

7. The seating device of claim 1, wherein the first rocking assembly includes a first cam coupled to the first end of the seat post, and a first cam follower coupled to the base and engaging the first cam, wherein the second rocking assembly includes a second cam coupled to the seat, and a second cam follower coupled to the second end of the seat post and engaging the second cam.

8. The seating device of claim 7, wherein the first cam and the first cam follower each include engagement elements that are meshed together to inhibit slippage between the first cam and the first cam follower, and wherein the second cam and the second cam follower each include engagement elements that are meshed together to inhibit slippage between the second cam and the second cam follower.

9. The seating device of claim 8, wherein the engagement elements of the first cam, the first cam follower, the second cam, and the second cam follower are teeth.

10. The seating device of claim 7, wherein the first rocking assembly includes a first energy storage member coupled to the first cam and the first cam follower to urge the first cam follower into engagement with the first cam, and wherein the second rocking assembly includes a second energy storage member coupled to the second cam and the second cam member to urge the second cam follower into engagement with the second cam.

11. The seating device of claim 10, wherein the first energy storage member and the second energy storage member are composed of an elastomeric material.

12. The seating device of claim 7, wherein the first rocking assembly includes a first rigid link coupled to the first cam and the first cam follower to limit displacement of the first cam follower relative to the first cam, and wherein the second rocking assembly includes a second rigid link coupled between the second cam and the second cam follower to limit displacement of the second cam follower relative to the second cam.

13. A seating device comprising:

a base supported on a ground surface;

a seat post extending from the base, the seat post having a first end adjacent the base, a second end opposite the first end, and a longitudinal axis extending between the first end and the second end;

a seat supported by the seat post above the base;

a first member configured to be coupled to the first end of the seat post;

a second member configured to be coupled to the base, wherein the first member is movable relative to the second member to change an orientation of the seat post relative to the base between a first angle relative to the ground surface and a second angle relative to the ground surface that is different than the first angle;

a rigid link coupled between the first member and the second member to limit movement of the first member relative to the second member; and an energy storage member coupled to the first member and the second member to urge the seat post toward the first position.

14. The seating device of claim 13, wherein the energy storage member is composed of an elastomeric material.

15. The seating device of claim 13, wherein the first member is a cam having a cam surface with a first series of engagement elements formed on the cam surface.

16. The seating device of claim 15, wherein the second member is a cam follower having a planar surface with a second series of engagement elements intermeshed with the first series of engagement elements of the cam surface.

17. The seating device of claim 16, wherein the cam surface is convex toward the cam follower.

18. A seating device comprising:

a base;

a plurality of wheels coupled to the base for supporting the base on a support surface;

a seat post extending from the base, the seat post having a first end adjacent the base, a second end opposite the first end, and a longitudinal axis extending between the first end and the second end;

a seat supported by the seat post above the base;

a first rocking assembly operable to angularly displace the seat post relative to the base, the first rocking assembly including a first cam coupled to the first end of the seat post, a first cam follower coupled to the base and engaging the first cam, and a first energy storage member coupled to the first cam and the first cam follower to maintain contact between the first cam and the first cam follower; and a second rocking assembly operable to angularly displace the seat relative to the seat post, the second rocking assembly including a second cam coupled to the seat, a second cam follower coupled to the second end of the seat post and engaging the second cam, and a second energy storage member coupled to the second cam and the second cam follower to maintain contact between the second cam and the second cam follower.

19. The seating device of claim 18, wherein the first rocking assembly includes a first rigid link coupled to the first cam and the first cam follower to limit displacement of the first cam relative to the first cam follower, and wherein the second rocking assembly includes a second rigid link coupled to the second cam and the second cam follower to limit displacement of the second cam relative to the second cam follower.

* * * * *